United States Patent [19]

Griffith

[11] 4,052,266

[45] Oct. 4, 1977

[54] METHOD AND APPARATUS FOR PURIFYING PROCESS WASTE EMISSIONS

[76] Inventor: Joseph W. Griffith, 8705 SW. White Court, Portland, Oreg. 97225

[21] Appl. No.: 359,475

[22] Filed: May 11, 1973

[51] Int. Cl.[2] ..... C10B 47/00; F23D 13/20; F23B 3/00

[52] U.S. Cl. ..... 201/15; 201/27; 201/41; 431/5; 431/173; 432/72; 110/28 F; 110/28 Y; 110/28 N

[58] Field of Search ..... 431/5, 173; 201/15, 201/41, 16, 27; 110/28 F, 28 N, 28 Y; 432/72

[56] References Cited

U.S. PATENT DOCUMENTS

| | | | |
|---|---|---|---|
| 1,899,887 | 2/1933 | Thiele | 201/37 |
| 1,918,397 | 7/1933 | Jezler | 110/28 F |
| 2,368,827 | 2/1945 | Hanson et al. | 110/28 F |
| 2,516,141 | 7/1950 | Newman et al. | 110/28 F |
| 2,769,504 | 11/1956 | Miller | 431/5 |
| 2,920,689 | 1/1960 | Tinker | 431/5 |
| 2,971,480 | 2/1961 | Sage | 110/28 F |
| 3,105,540 | 10/1963 | Hardgrove | 431/5 |
| 3,163,133 | 12/1964 | Montgomery | 110/28 F |
| 3,567,399 | 3/1971 | Altmann et al. | 431/5 |
| 3,671,402 | 6/1972 | Wenzel et al. | 201/15 |
| 3,712,796 | 1/1975 | Sansom et al. | 432/72 |
| 3,837,813 | 9/1974 | Ebeling et al. | 431/5 |

FOREIGN PATENT DOCUMENTS

| | | | |
|---|---|---|---|
| 111,054 | 6/1964 | Czechoslovakia | 110/28 F |

*Primary Examiner*—Jack Sofer

*Attorney, Agent, or Firm*—Oliver D. Olson

[57] ABSTRACT

The vapor emissions from process exhausts, containing one or more contaminants of the solid, liquid and gaseous types, are delivered to the inlet of a firebox which, in one embodiment, has a cylindrical side wall and a tangentially arranged oxidizing air-fuel burner. The hot gas outlet of the firebox is so arranged that the hot gases of combustion are retained within the firebox a sufficient length of time to insure substantially complete combustion of combustibles within the firebox. The portions of the firebox which are contacted by the gases of combustion are of a material or combination of materials having a surface capable of being heated to a temperature exceeding the ignition temperature of the air-fuel mixture of the burner and of combustible materials from the process, and an external mass capable of insulating said surface against external cooling below said ignition temperature. A tangentially arranged outlet through the cylindrical wall of the firebox serves to remove non-combustible solids centrifuged to said side wall by the high speed circulating gases of combustion. The purified hot gases may be recycled from the hot gas outlet to the process equipment, used for other purposes, or discharged to the atmosphere as a non-pollutant. In another embodiment, the firebox is an elongated cylinder having an inlet end for the process exhausts and burner, a downwardly directed outlet at the opposite, closed end for removal of non-combustible solids separated from the gases by linear momentum differences, and an upwardly directed vapor outlet intermediate the ends of the cylinder.

6 Claims, 3 Drawing Figures

METHOD AND APPARATUS FOR PURIFYING PROCESS WASTE EMISSIONS

BACKGROUND OF THE INVENTION

This invention relates to the purification of process exhausts, and more particularly to method and apparatus by which to render process exhausts ecologically acceptable.

Substantially all industrial processes presently exhaust to the rivers, lakes, oceans and atmosphere such large quantities of contaminants as to present an ecological hazard. Further, the loss of such potentially valuable substances represents a significant cost factor in process operation. Examplary of such processes are those involved in asphalt plants, charcoal plants, dry kilns, foundries, printing shops, garbage burners, diesel trucks, coal burners and many others. These contaminants include dust, noxious and odoriferous gases, solid organic materials and others.

Considerable effort has been made heretofore to reduce the exhaust of such contaminants to ecologically acceptable levels, while simultaneously recovering valuable substances for further use. In general, such efforts have been unsuccessful, primarily because of the inability to process, effectively, the vast magnitudes of such exhausts on an economical basis.

SUMMARY OF THE INVENTION

In its basic concept, this invention involves the introduction of process exhaust emissions into a firebox in which the hot gases of combustion of an air-fuel mixture are caused to move at high speed and to be retained therein for a predetermined time before being exhausted to an outlet, and in which firebox the entire inner surface is maintained at a temperature in excess of the ignition temperature of the air-fuel mixture.

It is by virtue of the foregoing basic concept that the principal objective of this invention is achieved; namely, to overcome the aforementioned limitations of prior processing efforts.

Another important object of this invention is the provision of method and apparatus of the class described which are versatile in their applicability to a wide variety of industrial processes with a minimum of modification of process equipment and which are operable efficiently and economically to process the large volumes of exhaust emissions which characterize such processes.

The foregoing and other objects and advantages of this invention will appear from the following detailed description, taken in connection with the accompanying drawing of preferred embodiments.

DESCRIPTION OF THE PREFERRED EMBODIMENTS

Figures 1, 2, 3:
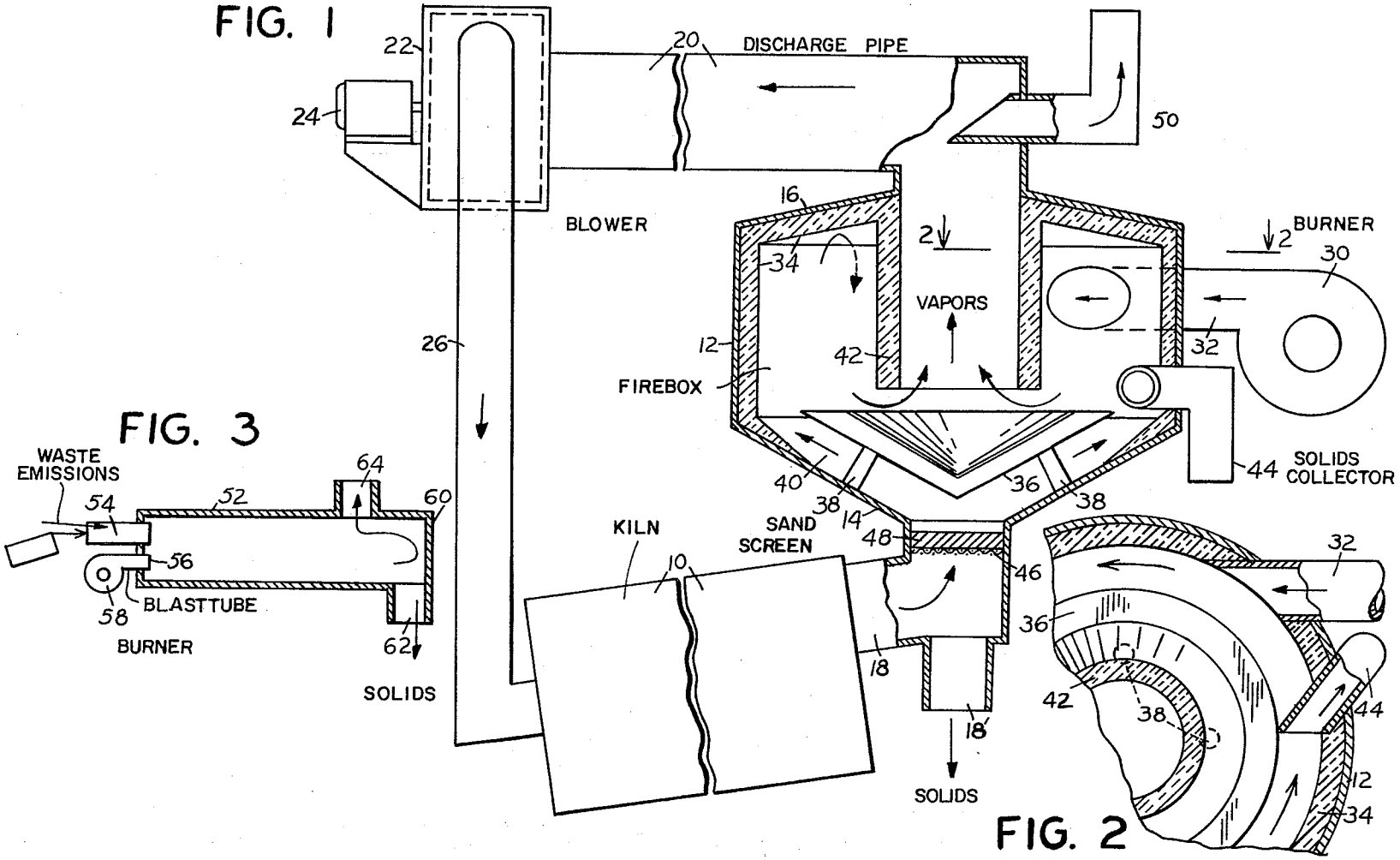
FIG. 1 is a foreshortened view in side elevation, showing in association with an industrial rotary process kiln, exhaust purifying apparatus embodying the features of this invention, parts being broken away to disclose details of construction.
FIG. 2 is a fragmentary sectional view taken along the line 2—2 in FIG. 1.
FIG. 3 is a view in longitudinal section of a second form of apparatus embodying the features of this invention.

For purposes merely of illustration, FIG. 1 of the drawing illustrates a rotary kiln 10 in which chunks of wood are processed for the production of charcoal. In this process of destructive distillation, the large volume of vapor exhaust therefrom includes such substances as water, carbon monoxide, methyl alcohol, acetic acid, acetone, turpentine, ammonia, solid particles of carbon, dirt and other debris, as well as a large variety of other hydrocarbons including tars and aromatic substances. All these materials are subjected to treatment, in accordance with this invention, to oxidize all organic substances to carbon dioxide, nitrogen and water; to vaporize all non-combustible volatile materials, and to collect, by centrifugal action, all non-combustible solid materials.

The apparatus of this invention includes a firebox chamber having a cylindrical side wall 12, a bottom wall 14 and a top wall 16. In the embodiment illustrated, these walls are made of sheet metal and the top and bottom walls are of conical shape, tapering outwardly in opposite directions toward their apices. The central apex portion of the bottom wall 14 is provided with an opening which registers with the outlet end of a vapor discharge pipe 18 the inlet end of which communicates with the outlet end of the rotary kiln 10. A downwardly projecting extension 18' of the discharge pipe provides an outlet for the main product of the kiln.

The central apex portion of the top wall 16 also is provided with an opening which may simply communicate with the atmosphere, or it may communicate with a discharge pipe for delivery to storage or other equipment for further use. In the embodiment illustrated, a discharge pipe 20 communicates the outlet opening with the inlet of a blower 22, preferably of the centrifugal type, driven by a motor 24. The outlet of the blower communicates through a return pipe 26 with the inlet end of the rotary process kiln 10. Thus, the hot, dry and clean vapor discharged from the firebox is recycled for use in the process.

Combustion gases for the firebox are provided by one or more burners 30 of the conventional oxidizing air-fuel mixture type. Typical of such burners are conventional fuel oil or natural gas burners well known in the art and commercially available from many sources. Each burner (one only is illustrated) is provided with an outlet blast tube 32 which extends through the cylindrical wall of the firebox and is disposed substantially tangent to the inner surface thereof. Ignition of the high velocity mixture of air and fuel entering the firebox results in the formation of combustion gases which circulate at high speed within the firebox chamber. Because of the downwardly extending heated outlet conduit 42, the swirling gases of combustion are caused to be retained within the firebox for several complete rotations before exiting through the outlet conduit.

It is an important feature of this invention that the entire inner surfaces of the firebox which are subject to the intense heat of the combustion gases, are of a material or combination or materials having a surface capable of being heated to a temperature exceeding the ignition temperature of the air-fuel mixture and having a mass capable of insulating said surface from external cooling below said ignition temperature. Thus, in the embodiment illustrated, the side wall 12 and top wall 16 are covered on their inner sides with a refractory insulation material 34 which is characterized by these two properties. A variety of refractory insulation materials suitable for the purpose of this invention are available commercially. A preferred type of material is that which is felted of fine fibers of refractory insulation material. Among these is the refractory fiber thermal insulation of Johns-Manville Corporation, marketed under the trademark Fiberchrome. It is an advantageous characteristic of such material that when a flame impinges upon its surface the exposed low heat capacity fibers become incandescent immediately, but the mass of the mat remains relatively cool. The use of such material therefore makes it possible to operate the firebox immediately, without preheating. Also, the temperature of combustible waste emission particles striking these incandescent surfaces is immediately raised above their ignition temperatures, to effect substantially immediate and complete combustion.

The illustrated firebox also is provided with a conical baffle 36 made of said refractory insulation material. It is spaced upwardly from the bottom wall 14 and supported in said spaced relation by such means as a plurality of circumferentially spaced blocks 38. The upper, flared end of the baffle is spaced concentrically inward of the side wall 12. Thus, the conical space 40 between the bottom wall and baffle communicates at its lower, apex end with the discharge pipe 18 and at its upper, annular end with the interior of the firebox adjacent the side wall.

The refractory baffle 36 serves the dual function of providing a conical inlet passageway and also of isolating the bottom wall 14 of the firebox from the intense heat within the latter. Thus, the bottom wall may be made of steel or other suitable metal for convenient coupling to the discharge pipe 18.

The opening in the top wall 16 registers with an outlet conduit 42 which extends downward into the firebox chamber and terminates at its lower end adjacent the baffle 36, radially inward of the annular upper end of the passageway 40. By this construction there is provided an annular opening between the baffle and outlet conduit through which combustion gases within the firebox chamber may exit. The outlet conduit also is made of the refractory insulation material described hereinbefore.

As the hot gases of combustion rotate at high speed within the firebox, non-combustible solid materials are centrifuged radially outward to the side wall, where they gravitate downward as they continue their rotation. A solids collector conduit 44 extends through the side wall 12 and its inner open end faces opposite the direction of rotation of the solids and gases. Thus, the solids are deflected into the conduit 44 for delivery to a point of collection.

The vapor exhaust from certain processes may include explosive substances which, upon contact with hot gases of combustion within the firebox, may cause flash back toward the processing equipment. To prevent such flash back, a foraminous screen 46 is installed across the central inlet opening in the bottom wall 14, and a quantity of sand 48 or other suitable granular refractory material is distributed over the screen. Thus, the vapor exhaust from the processing equipment may pass upwardly through the screen and porous layer of sand for admission to the firebox. However, in the event of flash back within the conical inlet passageway, it is extinguished at the screen.

Alternatively, the granular material may be replaced by a series of screens, as in the miner's lamp of Sir Humphrey Davies, a corrugated metal grid as in the Meker type Bunsen burner, and others.

An auxiliary hot gas outlet pipe 50 extends into the discharge pipe 20 and serves to regulate the pressure differential across the inlet and outlet of the firebox chamber. This pressure differential is produced by operation of the blower 22 and functions to assist the delivery of waste emissions from the kiln 10 to the firebox.

Although the shape and size of the incinerator described hereinbefore may be varied over a considerable range, the following illustrates a completely operable arrangement: The inner diameter of the side wall is 24 inches and its interior height is 16 inches; the inner diameter of the outlet conduit 42 is 10 inches and its length is 12 inches; the burner 30 provides an output of 400,000 BTU through a 4 inch diameter blast tube 32. The peripheral velocity of the gases of combustion is about 90 miles per hour, thus providing 22 orbits per second and a centrifugal force of about four times gravity. These parameters insure a multitude of collisions of particles in the vapor stream with the hot inner periphery of the firebox. The average drift velocity toward the outlet conduit 42 is about 2.5 miles per hour, while the draft velocity upward through it is about 15 miles per hour with the rotational velocity of about 40 miles per hour. This effectively maintains the gases against the hot interior surface of the outlet pipe conduit, with a force of about twice that of gravity.

The firebox of this size is capable of processing up to about 1,000 cubic feet of process vapor exhaust per minute. However, by increasing the BTU input of the burner system by a factor of ten, for example, the processing capability of the firebox also is increased by substantially the same factor.

FIG. 3 illustrates schematically a second form of apparatus embodying the features of this invention. It includes a substantially horizontal, hollow elongated firebox housing 52 of the refractory or other material described hereinbefore. The inlet end of the housing communicates with the outlet end of a process waste emission discharge pipe 54 and with the blast tube 56 of an oxidizing air-fuel burner 58. The opposite end of the housing is closed by an end wall 60.

Adjacent the end wall 60 is a downwardly extending solids discharge pipe 62. It serves to remove non-combustible solids which are separated from the gases of combustion by linear momentum differences, rather than by the centrifugal momentum differences provided by the structure of FIG. 1. This is achieved by the high velocity linear movement of the combustion gases from the burner tube 56 to the end wall 60.

Intermediate the ends of the housing 52 is a vapor outlet conduit 64 which extends upwardly therefrom. The space between this outlet and the end wall 60 serves to retain the gases of combustion within the housing for a time sufficient to effect substantially complete oxidization of the combustible content of the air-fuel mixture and waste emissions. If desired, the outlet conduit 64 may communicate with the kiln 10 or other process equipment through a blower 22, as in the embodiment of FIG. 1.

It is to be noted that the annular inner opening of the conical passageway 40 into the cylinder is offset radially outward from the inlet opening to the outlet conduit 42, and that the outlet opening of the waste emission discharge pipe 54 (FIG. 3) is offset 90° from the inlet opening to the outlet conduit 64. These offset arrangements require that waste emission particles entering from the inlet travel an indirect path to the outlet, whereby further to delay the exit of combustible components from the chamber and thus contribute further toward substantially complete oxidation thereof.

From the foregoing, it will be appreciated that the present invention provides a simplified and efficient method of purifying the large volumes of process waste emissions by apparatus which also is of simplified and therefore economical construction. The method and apparatus are versatile in their applicability to many types of industrial processes, with minimum modification of process equipment.

It will be apparent to those skilled in the art that various changes may be made in the method and in the size, shape, type, number and arrangement of parts described hereinbefore. For example, the baffle 36 may be omitted by covering the bottom wall 14 with the refeactory insulation material 34 and providing the emissions inlet in the side wall 12 tangent thereto. The outlet conduit 42 may be shorter than illustrated and baffled or otherwise arranged at its lower end to prevent the exit of combustibles until they have been substantially completely oxidized. The size of the firebox chamber and the number of burners 30 may be varied to accommodate the processing of variable volumes of waste emissions. The sheet metal shell of the firebox may be replaced by other materials, such as brick, or it may be omitted if the refractory insulation 34 is provided in self-supporting form. The outlet conduit and the inner surfaces of the firebox may be formed of a metal capable of being maintained at a temperature exceeding the ignition temperature of the air-fuel mixture. In this event the outer side of the metal is covered with insulation material capable of insulating the metal against cooling below said ignition temperature. These and other changes and modifications may be made, as desired, without departing from the spirit of this invention.

Having now described my invention and the manner in which it may be used, I claim:

1. Apparatus for purifying process vapor-laden waste emissions, comprising a. a chamber closed at both ends by end walls, b. an oxidizing air-fuel burner having an outlet communicating with the interior of the chamber for causing the gases of combustion to move therein at high speed, c. a waste emission inlet at one end of the chamber communicating the interior of the chamber with a source of waste emissions, d. a vapor outlet communicating with the interior of the chamber downstream from the inlet and upstream from the end of the chamber opposite said inlet, said outlet being offset from said inlet for causing the flow of waste emissions to reverse directions between said inlet and outlet, whereby to delay the exit of vapors from the chamber until the combustible content of the air-fuel mixture and waste emissions have been substantially completely oxidized, said offset providing an indirect path of travel of waste emission particles from the inlet to the outlet, whereby further to delay the exit of vapors from the chamber, e. the portions of the chamber and outlet which are contacted by the gases of combustion being constructed of material characterized by having a surface capable of being heated to and maintained at a temperature exceeding the ignition temperature of the air-fuel mixture and by a mass capable of insulating said surface against exterior cooling below said ignition temperature.

2. The apparatus of claim 1 wherein the chamber is elongated, the outlet of the burner and waste emission inlet are directed into the chamber from one end thereof for causing the gases of combustion to move linearly therethrough, and the vapor outlet communicates with the chamber intermediate the ends thereof, and the apparatus includes non-combustible solids discharge means at the end of the chamber opposite the burner outlet for removing from the chamber non-combustible solids separated from the gases of combustion by linear momentum differences.

3. The apparatus of claim 1 wherein the chamber is cylindrical and the outlet of the burner is disposed substantially tangent thereto for causing the gases of combustion to rotate therein, and the apparatus includes non-combustible solids discharge means at the periphery of the chamber for removing from the latter non-combustible solids centrifuged to the periphery of the chamber by the rotating gases of combustion.

4. The apparatus of claim 3 wherein the waste emission inlet includes an inlet passageway through one end wall of the chamber and terminating in an annular opening adjacent the side wall of the chamber, and the vapor outlet comprises an outlet conduit extending centrally through the opposite end wall of the chamber and terminating adjacent the annular opening but radially inward of the latter, whereby to provide said indirect path of travel of waste emission particles.

5. The apparatus of claim 4 including baffle means of said characterized material spaced inwardly of said one end wall of the chamber and defining therebetween a conical inlet passageway terminating at its inner end in said annular opening.

6. Apparatus for purifying process vapor-laden waste emissions, comprising:

a. a chamber closed at both ends by end walls, b. oxidizing air-fuel burner means having an outlet communicating with the interior of the chamber for causing the gases of combustion to move therein at high speed, c. waste emission inlet means at one end of the chamber communicating the interior of the chamber with a source of waste emissions, d. vapor outlet means communicating with the interior of the chamber downstream from the inlet means and upstream from the end of the chamber opposite said inlet means for causing the flow of waste emissions to reverse directions between said inlet means and outlet means, whereby to delay the exit of vapors from the chamber until the combustible content of the air-fuel mixture and waste emissions have been substantially completely oxidized, e. the portions of the chamber and outlet means which are contacted by the gases of combustion being constructed of material characterized by having a surface capable of being heated to and maintained at a temperature exceeding the ignition temperature of the air-fuel mixture and by a mass capable of insulating said surface against exterior cooling below said ignition temperature, and f. means in the waste emission inlet means for preventing flame flash back in the chamber from entering the source of waste emissions, said flash back preventing means comprising a foraminous member disposed horizontally and transverse to a vertical portion of the inlet means, and a quantity of granular refractory material distributed over the horizontal foraminous member.

* * * * *